US009200785B2

(12) United States Patent
Yang

(10) Patent No.: US 9,200,785 B2
(45) Date of Patent: Dec. 1, 2015

(54) LED LIGHT HAVING EDGE MOUNTED LED'S

(71) Applicant: Kevin Yang, Lomita, CA (US)

(72) Inventor: Kevin Yang, Lomita, CA (US)

( * ) Notice: Subject to any disclaimer, the term of this patent is extended or adjusted under 35 U.S.C. 154(b) by 291 days.

(21) Appl. No.: 13/963,496

(22) Filed: Aug. 9, 2013

(65) Prior Publication Data

US 2015/0043227 A1 Feb. 12, 2015

(51) Int. Cl.

| | |
|---|---|
| ***F21S 4/00*** | (2006.01) |
| ***F21V 19/00*** | (2006.01) |
| *F21Y 101/02* | (2006.01) |

(52) U.S. Cl.

CPC ..... *F21V 19/0025* (2013.01); *F21Y 2101/02* (2013.01)

(58) Field of Classification Search

CPC .... F21Y 2103/003; F21S 4/003; F21S 4/008; F21V 19/001; F21V 19/0015; F21V 19/003; F21V 19/005

See application file for complete search history.

(56) References Cited

U.S. PATENT DOCUMENTS

| | | | | |
|---|---|---|---|---|
| 6,244,728 | B1 * | 6/2001 | Cote et al. | 362/249.06 |
| 6,525,668 | B1 * | 2/2003 | Petrick | 340/815.45 |
| 6,712,486 | B1 * | 3/2004 | Popovich et al. | 362/241 |
| 6,727,652 | B2 * | 4/2004 | Sivacumarran | H01R 33/09 315/185 S |
| 6,902,308 | B2 * | 6/2005 | Love | F21S 8/00 361/806 |
| 7,390,108 | B1 * | 6/2008 | Wang | 362/294 |
| 7,396,142 | B2 * | 7/2008 | Laizure et al. | 362/240 |
| 8,029,177 | B2 * | 10/2011 | Schmierer | B60Q 1/2665 362/217.1 |
| 2002/0149933 | A1 * | 10/2002 | Archer et al. | F21S 4/006 362/234 |

* cited by examiner

*Primary Examiner* — Ismael Negron
(74) *Attorney, Agent, or Firm* — Clement Cheng

(57) ABSTRACT

An LED light includes an LED chip having a first terminal and a second terminal, and a layer assembly having first and second metal conduction layers an insulation layer sandwiched between them. An edge of the layer assembly includes a first mounting surface formed on the first conduction layer, and a second mounting surface formed on the second conduction layer. The insulation layer is located between the first mounting surface and the second mounting surface, with the first and second terminals connected to the first and second mounting surfaces, respectively.

7 Claims, 6 Drawing Sheets

LED LIGHT HAVING EDGE MOUNTED LED'S

FIELD OF THE INVENTION

The present invention is in the field of LED lights.

DISCUSSION OF RELATED ART

Traditionally, light emitting diodes (LEDs) have been mounted to circuit boards which are then mounted to heatsinks. Heat sinks typically include a variety of different fin configurations. LED lights have also been mounted to an edge of a circuit board. The LED light is becoming more popular recently because of its longevity and long duty cycle. Heat dissipation remains one of the most pressing challenges to LED light innovation. As a result, many designs have been created for various heat dissipation strategies.

SUMMARY OF THE INVENTION

An edge mounted LED light includes an LED chip having an LED chip first terminal and an LED chip second terminal. A layer assembly has conduction layers, namely a first conduction layer and a second conduction layer that sandwich an insulation layer between them. The first conduction layer and the second conduction layer are made of metal having thermal conductivity and electrical conductivity. An edge of the layer assembly includes a first conduction layer mounting surface formed on the first conduction layer, and a second conduction layer mounting surface formed on the second conduction layer. The insulation layer is located between the first conduction layer mounting surface and the second conduction layer mounting surface. An LED chip first terminal is formed on the LED chip, and an LED chip second terminal is formed on the LED chip. The LED chip first terminal is connected to the first conduction layer and the LED chip second terminal is connected to the second conduction layer.

A first soldered connection is formed between the LED chip first terminal and the first conduction layer, and a second soldered connection is formed between the LED chip second terminal and the second conduction layer. The LED chip is directly soldered to the first conduction layer and the second conduction layer without being connected to a circuit board. The conduction layers are made of sheets of metal having rectangular cross-section. The LED chip first terminal is aligned with an upper edge of the LED chip and the LED chip second terminal is aligned with a lower edge of the LED chip. A layer assembly opening is formed through a thickness of the layer assembly. A layer assembly opening is formed through a thickness of the layer assembly. A connector passes through the layer assembly opening. The connector is insulated from the conduction layers by a connector insulator.

The edge mounted LED light optionally includes a retainer frame having one or more slots for receiving the edge mounted LED light. The retainer frame further includes a clip arm for providing a clip snap on attachment. The retainer frame optionally includes retainer frame openings for natural or forced convection.

It is an object of the present invention to provide an LED light that does not use a circuit board substrate for mounting the LED chip to the circuit board.

Figure 1:
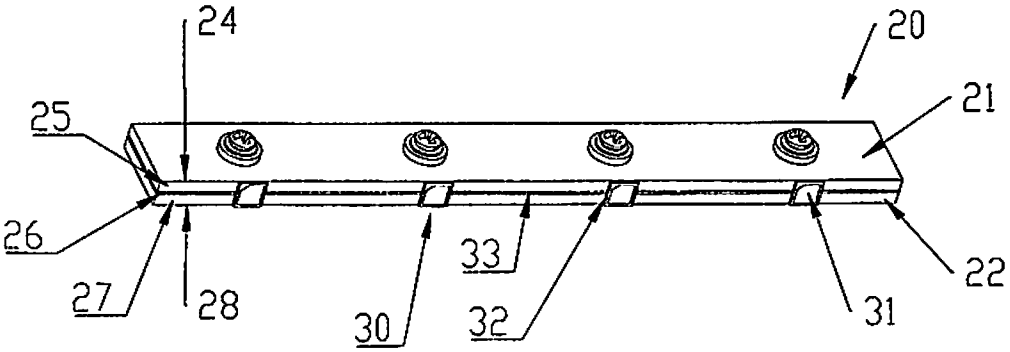
FIG. 1 is a perspective view of the heatsink apparatus.
Figure 2:
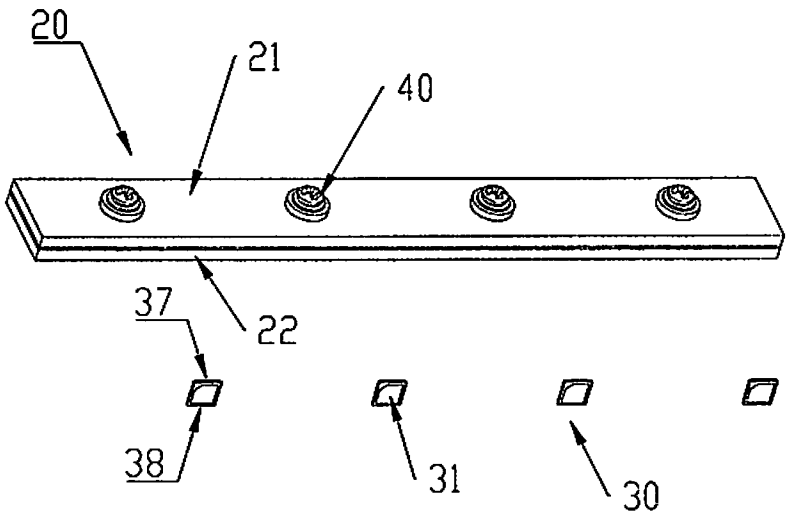
FIG. 2 is a perspective exploded view of the present invention showing installation of LED chips.
Figure 3:
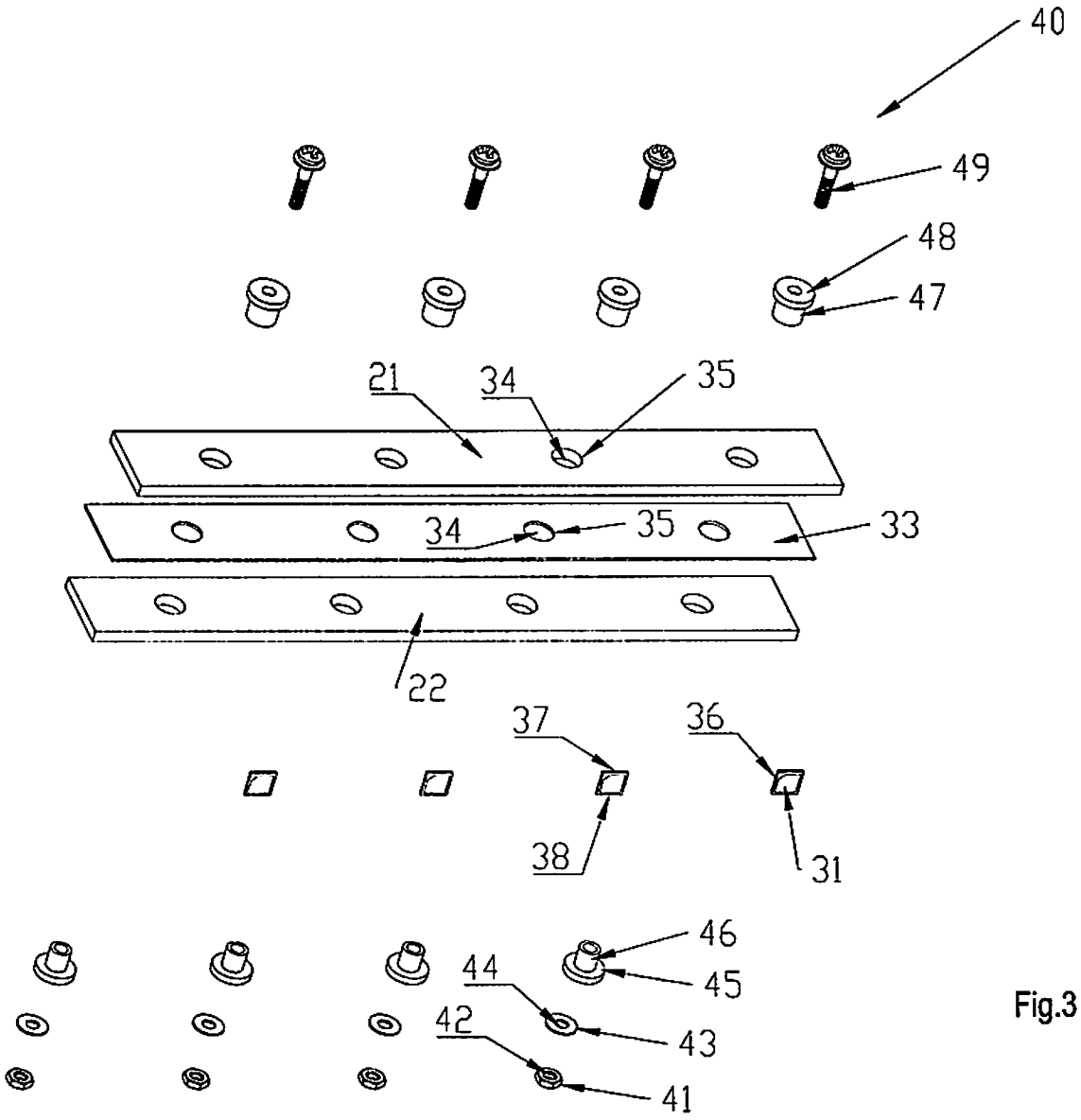
FIG. 3 is a perspective exploded view of the present invention showing assembly of the heatsink apparatus.
Figure 4:
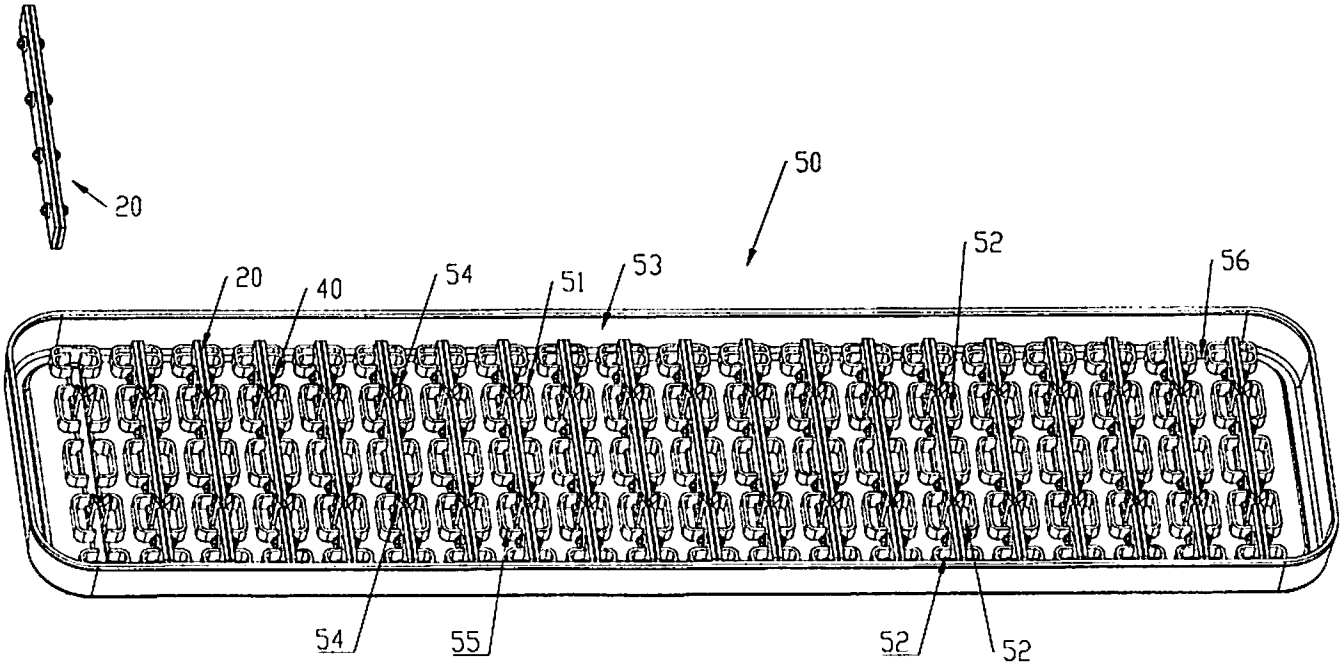
FIG. 4 is a back perspective view of the frame showing press in clip attachment mechanism installation for the LED modules.
Figure 5:
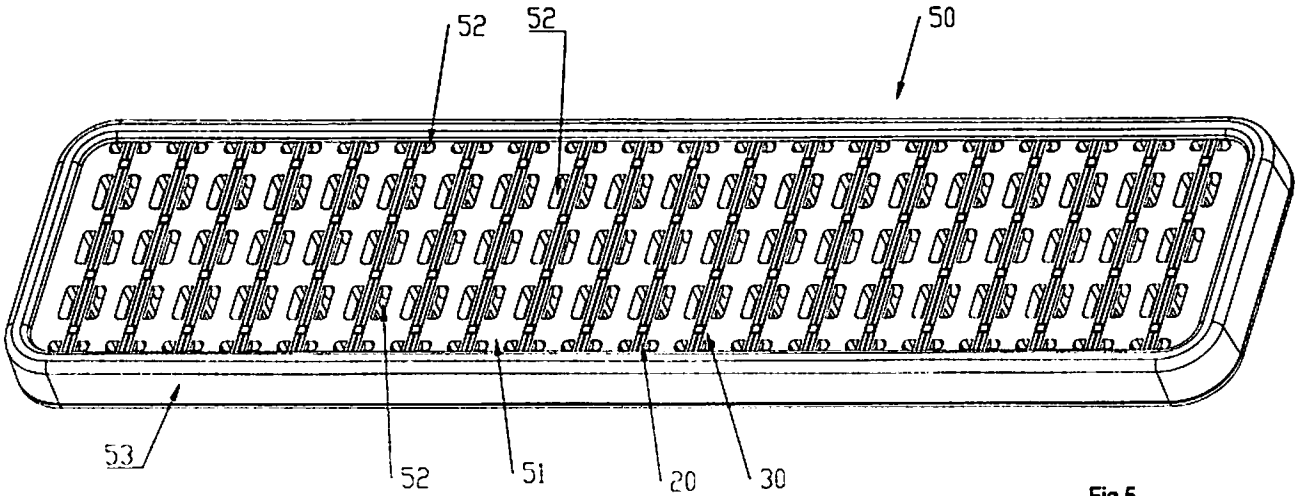
FIG. 5 is a front perspective view of the frame showing installation.
Figure 6:
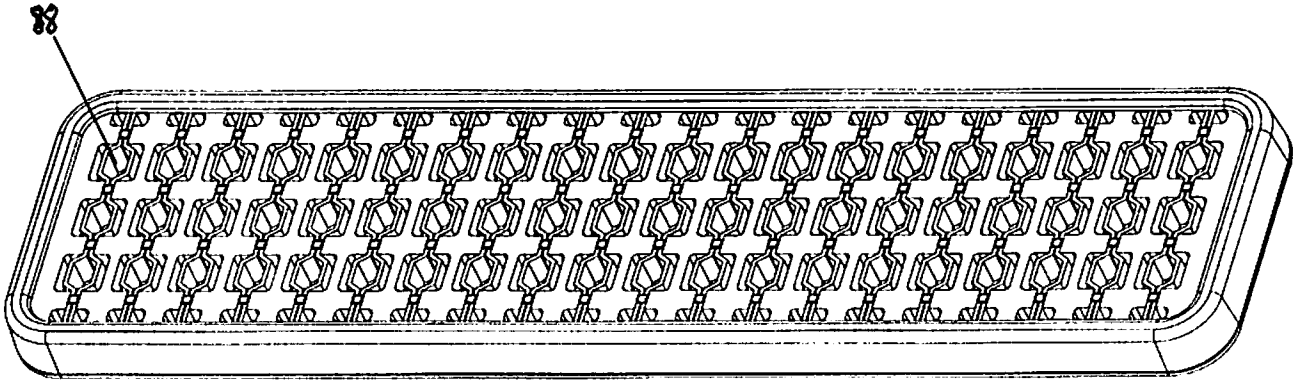
FIG. 6 is a front perspective view of the alternate embodiment of the heatsink apparatus showing the convection gaps.

The following call out list of elements can be a useful guide in referencing the element numbers of the drawings.

20 Layer Assembly
21 First Conduction Layer
22 Second Layer Conduction
24 First Conduction Layer Outside Surface
25 First Conduction Layer Mounting Surface
26 Insulation Layer Mounting Surface
27 Second Conduction Layer Mounting Surface
28 Second Conduction Layer Outside Surface
30 Light Element
31 LED Chip
32 LED Chip Side Edge
33 Insulation Layer
34 Layer Assembly Opening
35 Layer Assembly Opening Edge
36 LED Chip Mounting Surface
37 LED Chip First Terminal
38 LED Chip Second Terminal
40 Connector
41 Nut
42 Nut Opening
43 Nut Washer
44 Nut Washer Opening
45 Second Insulator Base
46 Second Insulator Stem
47 First Insulator Stem
48 First Insulator Base
49 Connector Stem
50 Retainer Frame
51 Retainer Frame Mounting Surface
52 Retainer Frame Opening
53 Retainer Frame Sidewall
54 Clip Arm
55 Retainer Frame Opening Sidewall
56 Retainer Frame Electrical Connection
88 Gap

DETAILED DESCRIPTION OF THE PREFERRED EMBODIMENT

The layer assembly 20 is made of a laminate of a first conduction layer 21 and a second conduction layer 22 sandwiching an insulation layer 33 between them. The first conduction layer and the second conduction layer are the two conduction layers. The conduction layers conduct electricity as well as heat. The conduction layers bring electricity to the LED chip 31 while conducting heat away from the LED chip 31. The conduction layers are formed as strips of metal, such as steel. The conduction layers are both preferably extruded flat metal bars, or rolled flat metal bars but can also be made from sheets of metal. The metal bars are preferably of rectangular cross-section and having high thermal conductivity. The conduction layers may have coatings applied on a surface of the conduction layers to limit corrosion. The conduction layers may have sacrificial anode attachments for inhibiting corrosion. The layer assembly 20 is generally flat and planar and can have a gap 88 where the first conduction layer separates from the second conduction layer. The gap 88 can be used for improving thermal convection properties of the layer assembly 20.

An edge of the layer assembly 20 provides a mounting surface of the layer assembly that can be connected to an LED chip mounting surface 36 located on the LED chip. Any number of light elements 30 such as LED chips can be mounted to the edge where the mounting surface of the layer assembly is connected to the LED chip mounting surface 36. The LED chip mounting surface is located on the underside of the LED chip. Also, terminals of the LED chip are located on the underside of the LED chip. The LED chip mounting surface is preferably flat to match a flat edge of the layer assembly 20.

The conduction layers further include a first conduction layer outside surface 24 that is orthogonal or normal to the edge mounting surface where the light elements 30 are mounted. The light elements 30 are mounted to a first conduction layer mounting surface 25. The second conduction layer mounting surface 27 also receives a portion of the light elements 30. The second conduction layer also has a second conduction layer outside surface 28 that is preferably open to the air and being convectively cooled by ambient air. Ambient air can be under forced or natural convection. The insulation layer also has an insulation layer mounting surface 26. The edge of the layer assembly 20 includes the first conduction layer mounting surface 25, parallel to the second conduction layer mounting surface 27, parallel to the insulation layer mounting surface 26.

Solder paste can be deposited on the edge of the layer assembly 20. The solder paste then receives a light element such as an LED chip 31. The LED chip is placed on the edge of the layer assembly 20 after the solder paste is deposited. The solder paste is then heated according to manufacturer specifications. The heating of the solder paste reflows the solder and forms a mechanical bond, thermal connection and electrical connection between LED chip 31 and the edge of the layer assembly 20. The LED chip side edge 32 is preferably 90° with the plane of the layer assembly layers. Electrical terminals are found on opposite ends of the LED chip 31. The electrical terminals are mounted with the LED chip first terminal 37 connected to the first conduction layer 21 and the LED chip second terminal 38 connected to the second conduction layer 22. The terminals of the LED chip are located with the first terminal 37 being located on an upper edge of the LED chip and the second terminal 38 located on a lower edge of the LED chip.

The layer assembly 20 may also have layer assembly openings 34 that are drilled through a thickness of the layer assembly. The layer assembly opening 34 they have a circular layer assembly opening edge 35. The layer assembly opening can receive a connector. A connector 40 can be formed as a bolt capable of receiving one or more nuts 41. The nuts 41 have a nut opening 42 that is threaded and can be connected to the bolt connector 40. The nut is assisted by a washer 43 that also has a nut washer opening 44 of sufficient diameter to connect to a shaft shaped connector stem 49 of a connector 40.

The connector insulator insulates the connector from the layer assembly 20. The connector does not make electrical connection between the two conduction layers. The connector insulator can be made of a first insulator having a first insulator base 48 connected to a first insulator stem 47. The first insulator base 48 protrusion above a first conduction layer outside surface 24 to provide an offset of the connector to be offset away from the first conductor layer outside surface. The connector insulator can also have a second insulator that has a second insulator stem 46 formed with a second insulator base 45. The second insulator base 25 offsets the nut 41 and nut washer 43 a set distance away from the second conduction layer outside surface 28. The second insulator base protrudes about a surface of the second conduction layer outside surface 28. The second insulator stem 46 can fit inside the first insulator stem 47 to provide a cooperative alignment for the connector stem 49 which passes through the first insulator stem opening and the second insulator stem opening.

The layer assembly 20 are preferably made into separate modules that can be snap fit into a retainer frame 50. A number of modules such as twenty modules can be inserted into slots formed on a retainer frame 50. The retainer frame 50 generally includes a retainer frame mounting surface 51 that has a number of retainer frame openings 52. The retainer frame mounting surface 51 is preferably bounded by a retainer frame sidewall 53. The retainer frame mounting surface 51 further includes a retainer frame opening sidewall 55. The retainer frame opening sidewall can cooperate with a clip arm 54 for clip on pressfit attachment of layer assemblies 20 within the retainer frame 50.

The retainer frame 50 preferably holds the layer assemblies in a regular array of equally distant spaced apart layer assemblies 20. The retainer frame mounting surface 51 can be coated with a metallic reflective finish for maximizing light transmission. The retainer frame mounting surface 51 is preferably integrally formed with the retainer frame sidewall 53. The retainer frame openings 52 can be formed as rectangular openings to allow airflow through the retainer frame openings 52. The retainer frame openings 52 can further be aligned with a gap 88 formed between LED chips 31. The clip arms 54 can be made in pairs, or on one side only of the retainer frame openings 52. The clip arms 54 are preferably also made integrally formed with the retainer frame 50 such as by a single step or cycle of a plastic injection mold. The clip arm 54 generally has a bayonet arrow profile to allow a hook retention of the layer assembly 20 within the retainer slot. The retainer frame opening sidewall 55 may protrude less than the height of the retainer frame sidewall 53. A preformed retainer frame in electrical connection 56 can be injection molded with a retainer frame 50 by partially encapsulating an electrical connector into the retainer frame 50 to provide an electrical connection between the various modules of the layer assemblies 20.

The edge mounted LED light is circuit board free. The edge mounted LED light has direct mounting meaning that the LED chip is soldered directly to the heatsink and does not have a circuit board substrate. Electricity is supplied to the LED light through the heatsink. The LED chips on an edge are in parallel to all of the LED chips on the same edge. The conduction layers can be energized by a socket connection in a slot of the retainer frame. Replacement of a faulty or burned out layer assembly 20 can be done by hand. The best mode of the present invention is to avoid having a circuit board substrate that the LED chip must be first mounted to. The LED chip should be mounted directly to the conductive heatsink. The conductive heat sinks have differing electrical polarity to provide electrical power to the LED chip.

The following detailed description of the preferred embodiment describes a preferred embodiment of the present invention. The invention will now be defined by the claims below.

The invention claimed is:

1. LED light comprising:

a. an LED chip having a first terminal and a second terminal;

b. a layer assembly comprising a first conduction layer, a second conduction layer, and an insulation layer sandwiched between them, wherein the first conduction layer and the second conduction layer are made of metal having thermal conductivity and electrical conductivity;

c. a first conduction layer mounting surface formed on an edge of the first conduction layer, a second conduction layer mounting surface formed on an edge of the second conduction layer;

d. wherein the LED chip first terminal is connected to the first conduction layer and wherein the LED chip second terminal is connected to the second conduction layer;

e. a layer assembly opening formed through a thickness of the layer assembly; and further comprising a connector passing through the layer assembly opening, wherein the connector is insulated from the conduction layers by a connector insulator.

2. An edge mounted LED light of claim 1, further comprising: a retainer frame having a slot for receiving the edge mounted LED light, wherein the retainer frame further includes a clip arm for providing a clip snap on attachment.

3. An edge mounted LED light of claim 1, further comprising: a retainer frame having a slot for receiving the edge mounted LED light, wherein the retainer frame has retainer frame openings for natural or forced convection.

4. An edge mounted LED light of claim 1, wherein an edge of the LED chip first terminal is aligned with an upper edge of the LED chip and wherein an edge of the LED chip second terminal is aligned with a lower edge of the LED chip, further comprising: a retainer frame having a slot for receiving the edge mounted LED light, wherein the retainer frame has retainer frame openings for natural or forced convection.

5. An edge mounted LED light of claim 1, further comprising: a first soldered connection formed between the LED chip first terminal and the first conduction layer, and a second soldered connection formed between the LED chip second terminal and the second conduction layer, wherein the LED chip is directly soldered to the first conduction layer and the second conduction layer in without using a circuit board.

6. An edge mounted LED light of claim 5, wherein the first conduction layer, the second conduction layer are both made of sheets of metal having rectangular cross-section.

7. An edge mounted LED light of claim 5, further comprising: a retainer frame having a slot for receiving the edge mounted LED light, wherein the retainer frame further includes a clip arm for providing a clip snap on attachment.

* * * * *